US005543041A

United States Patent [19]

Okazaki et al.

[11] Patent Number: 5,543,041

[45] Date of Patent: Aug. 6, 1996

[54] SUPPLY SYSTEM OF PETROLEUM HEAVY OIL CONTAINING MAGNETIC FINE PARTICLES

[75] Inventors: Hajime Okazaki, Yokohama; Manabu Kazato, Fujisawa; Masaoki Ouchi, Tokyo; Haruki Nagano; Masaru Ushio, both of Yokohama; Kozo Kamiya, Kamakura, all of Japan

[73] Assignees: Nippon Oil Company, Ltd.; Nippon Petroleum Refining Company, Ltd., both of Tokyo, Japan

[21] Appl. No.: 256,142

[22] PCT Filed: Nov. 10, 1993

[86] PCT No.: PCT/JP93/01634

§ 371 Date: Jul. 6, 1994

§ 102(e) Date: Jul. 6, 1994

[87] PCT Pub. No.: WO94/11463

PCT Pub. Date: May 26, 1994

[30] Foreign Application Priority Data

Nov. 12, 1992 [JP] Japan ..... 4-302379
Aug. 13, 1993 [JP] Japan ..... 5-201635

[51] Int. Cl.[6] ..... C01G 31/09; C01G 32/02

[52] U.S. Cl. ..... 210/181; 210/182; 210/195.1; 210/223; 210/254; 210/259; 210/295; 196/46.1; 208/251 R

[58] Field of Search ..... 210/181, 182, 210/195.1, 223, 254, 259, 295, 333.01; 196/46, 46.1; 208/251 R

[56] References Cited

U.S. PATENT DOCUMENTS 3,725,262 4/1973 Mattice et al. ..... 210/223
3,954,611 5/1976 Reedy ..... 210/223
4,495,074 1/1985 Hagiwara et al. ..... 210/223
4,836,914 6/1989 Inoue et al. ..... 208/251 R
4,904,345 2/1990 McCants ..... 196/46.1
5,112,479 5/1992 Srimongkolkul ..... 210/182
5,137,644 8/1992 Stone ..... 210/333.01

FOREIGN PATENT DOCUMENTS 0555593 8/1993 European Pat. Off. .

*Primary Examiner*—Peter A. Hruskoci
*Assistant Examiner*—Theodore M. Green
*Attorney, Agent, or Firm*—Oblon, Spivak, McClelland, Maier & Neustadt, P.C.

[57] ABSTRACT

The present invention relates to a supply system for pre-treating a petroleum distillation residual oil to be fed to a hydrogenation apparatus. In order to remove iron fine particles having a particle size of less than 25μ in the feed oil which could be not removed in the prior art, by constituting a system comprising a heater for heating the feed oil to a given temperature by heat exchange with a high temperature bottom oil of a fractionating tower after hydrogenation treatment of the feed oil, a filter equipped with a back washing mechanism for filtering solid materials in the feed oil after heating, and a high gradient magnetic separator for magnetically separating magnetic iron fine particles having a particle size of less than 25μ contained in the feed oil. By the use of the above bottom oil of the fractionating distillation tower as a washing oil of the high gradient magnetic separator, iron fine particles in the feed oil were able to be removed by repeating an iron removing operation and a washing operation. By the use of this supply system for pre-treating the feed oil, iron fine particles attributable to clog and deterioration of a catalyst layer of the hydrogenation apparatus can be reduced, thereby the time capable of continuous running of the conventional hydrogenation apparatus can be extended.

4 Claims, 3 Drawing Sheets

SUPPLY SYSTEM OF PETROLEUM HEAVY OIL CONTAINING MAGNETIC FINE PARTICLES

TECHNICAL FIELD

The present invention provides a novel constitutional system for supplying a feed oil in a hydrogenation apparatus such as a hydrodesulfurization apparatus, a hydrocracking apparatus and the like of petroleum heavy oils. Particularly, the present invention relates to a supply system for pre-treating a feed oil containing magnetic iron fine particles.

BACKGROUND ART

Fine particles composed of a small amount of iron or iron compounds are generally contained in a petroleum heavy oil. These fine particles come to be contained in the above petroleum heavy oil as fine particles and the like peeled off from tanks, pipelines and a distillation apparatus owing to corrosion of them when a crude oil is transported from an area of production by a tanker, stored in a tank and fed to the distillation apparatus through pipelines. When such a petroleum heavy oil, particularly a petroleum heavy residual oil is used as a feed oil in a fixed bed hydrogenation apparatus (hydrodesulfurization or hydrocracking apparatus), a fine particulate iron component contained in the feed oil deposits on a catalyst or between catalyst particles to clog the reactor thereby increasing pressure drop or to reduce activity of the catalyst particles. Clogging of the reactor increases pressure drop and deflects the feed oil to reduce its flow rate and sometimes to shut down operation of the apparatus. Deterioration of the catalyst is required to replace the catalyst, resulting in a significant loss for the operation of the hydrogenation apparatus.

In general, in petroleum refining industry, a filter for solid materials is usually provided in a raw material oil feeding line in order to remove solid impurities contained in the oil. The conventional filter is to prevent damage of a pump and the like, and it can separate solid materials having a large particle size by filtering, but can not separate to remove fine particles of the order of microns as described later. These fine particles are considered to be fine particles composed of iron compounds as mentioned above and have been become a main factor for obstructing the operation of the hydrogenation apparatus. In order to remove these fine particles, it has been attempted that a filter paper and a membrane filter having a fine mesh are used as a filter or a centrifugal separator is used. The above filter, however, causes great pressure drop and also rapid clogging so,that it cannot be used practically for a long time. Even if the filter part is replaced, the replacement is required to be often conducted so that the filter is unsuitable for treating a large amount of the raw material oil. The centrifugal separator also has a problem with respect to performances and was not of practical use.

Recently, a high gradient magnetic separator has been attempted to be used to remove magnetic particles in a fluid. In the high gradient magnetic separator for removing magnetic fine particles, a ferromagnetic packing is placed in a space of a high magnetic field, and a high magnetic field gradient is caused to form around the packing, thereby magnetic fine particles are caused to adhere to the packing to separate from the fluid. The high gradient magnetic separator has been developed and utilized in the fields such as chemistry, iron and steel, mineral dressing, water treatment and prevention of environmental pollution. Utilization of the high gradient magnetic separator in petroleum refining industry is first attempted in Japanese Patent Laid-Open No. 62-54790 by which it was found that iron fine particles can be removed by the use of the magnetic separator. However, the above patent application was incomplete as a system which can be commercially run.

DISCLOSURE OF INVENTION

An object of the present invention is to provide a pre-treating system including treatment of a feed oil containing iron fine particles by the use of a high gradient magnetic separator and washing treatment of adhered iron fine particles in order to separate and remove iron fine particles in the feed oil which prevent a long-term operation of a hydrogenation apparatus such as hydrocracking and hydrodesulfurization apparatuses for petroleum distillation residual oil, thereby making it possible to continuously operate the above hydrogenation apparatus for a long time.

The above subject is solved by the following means of the present invention. The object of the present invention is achieved by providing a pre-treating part comprising a heating apparatus for heating a feed oil containing magnetic fine particles to a given temperature, a filter for solid materials for removing the fine particles having a particle size of 25μ or more, and a high gradient magnetic separator for removing the fine particles having a particle size of less than 25μ in the feed oil, in a feeding line of a hydrogenation apparatus, utilizing a fractionating tower bottom oil of the latter step of the hydrogenation apparatus as a heat source for heating the feed oil, and providing a washing line for using the fractionating tower bottom oil as a washing oil for the filter for solid materials and the high gradient magnetic separator.

As a first step for collectively solving the above-mentioned subject, the present inventors analyzed substances adhered to the used (wasted) catalyst which adhere to the catalyst and firmly bond catalyst particles to one another to search substances responsible for increasing pressure drop of a catalyst layer of the hydrogenation apparatus or for solidifying the catalyst and to explore a mechanism by which the substances act. As a result, it was found that main components of the substances adhered to catalyst are iron, sulfur, carbon and the like, and among them, iron component occupies about 40% based on the total components. In addition, it was found that the iron component is iron sulfide by X-ray diffraction analysis. Moreover, it became clear that spherulite coke grows from iron sulfide as a nucleus, and iron sulfide deposits on the surface of the catalyst from scanning electron microphotographs of the substances adhered to catalyst. From these results, it was considered that iron sulfide in the feed oil deposits on the surface of catalyst and between catalyst particles to reduce a vacant space of the catalyst bed, thereby causing pressure drop. In addition, when pressure drop occurs, the oil to be treated deflects in the catalyst bed, and the part of the catalyst bed in which the oil became rather difficult to flow increases its temperature to accelerate coking reactions, thereby causing solidification and deterioration of the catalyst.

A continuous back-washing filter for solid materials capable of removing fine particles having a particle size of 25μ or more was provided in a feed oil feeding line for hydrogenation treating, but fine particles having a particle size of less than 25μ pass through the filter and reach the hydrogenation catalyst layer, so that clogging of the reaction tower similarly occurred in the long-term running. Incidentally, a filter having a filter particle size of less than 25μ is not possible to be continuously run practically owing to clogging of the filter surface and rapid blocking of the filter. A particle size distribution of iron fine particles in the feed oil after passing through the above filter was measured. As a result, the particles having particle sizes of from 0.1μ to less than 1μ, from 1μ to less than 8μ, and from 8μ to less than 25μ were from 5 to 50%, from 5 to 20%, and from 30 to 80%, respectively, and were extremely fine. The iron content in the feed oil after passing through the filter was from about 5 to 50 ppm, and it was found that the iron compounds are iron sulfide mainly composed of $Fe_7S_8$ by analysis. They have a magnetic susceptibility of from about $50\times10^{-6}$ to $200\times10^{-6}$ emu/g by measuring and exhibit paramagnetic.

From the above studies, the present inventors considered that iron fine particles in the feed oil can be effectively removed by a high gradient magnetic separator because the main component of the fine particles is paramagnetic iron sulfide, and its magnetic susceptibility is relatively great among paramagnetic substances, and the particles having a particle size of 1μ or more occupy about 90%, and further investigated a method for removing the iron fine particles and an apparatus for removing them.

A feed oil used in the present invention is petroleum heavy oils and includes, for example, petroleum distillation residual oils obtained by atmospheric or vacuum distillation of a various kinds of petroleum crude oils and deasphalting oils of these distillation residues. These petroleum heavy oils contain fine particles composed of iron or iron compounds, sulfur, nitrogen, asphaltene and the like as impurities.

A high gradient magnetic separator used in the present invention is a magnetic separator designed so that a ferromagnetic packing is arranged in a space of a uniform high magnetic field generated by an external electromagnetic coil, ferromagnetic or paramagnetic fine particles are caused to adhere to the surface of the packing by a high magnetic field gradient of from 1 to 20 k gauss usually generated around the packing to separate them from the feed oil, and then the adhered fine particles are washed to remove.

As the above ferromagnetic packing, an assembly of ferromagnetic fine wires such as a steel wool or a steel net having a diameter of from 1 to 1,000μ usually, an expanded metal, and a shell-like metal piece are used. Among them, the shell-like metal piece is preferred because it is easily handled and has a high performance for separating iron fine particles. The shell-like metal piece preferably has the major axis of from 0.5 to 5 m/m, a curvature height of from 0.3 to 0.5 m/m, and a bulk specific gravity of from 3 to 4, and is ferromagnetic. As the metal, stainless steel excellent in anti-corrosion, thermal resistance and strength is preferred.

The step for magnetically removing iron fine particles in a feed oil by a high gradient magnetic separator comprises introducing the feed oil in a space of a magnetic field of the magnetic separator, and iron fine particles are caused to adhere to a ferromagnetic packing placed in the space of the magnetic field to remove the iron fine particles from the feed oil. Next, the step for removing the iron fine particles adhered to the packing from the packing by washing comprises removing the iron fine particles from the packing by washing when the amount of the iron fine particles adhered to the packing reaches to a given constant or a limit, because the amount of the iron fine particles which can be adhered to the packing having a constant surface area has a limit. This step for removing by washing is carried out by cutting off the magnetic field to demagnetize the iron fine particles and discharging the fine particles from the magnetic separator with a washing oil. Conditions for magnetically removing iron fine particles contained in the feed oil and for washing and removing the iron fine particles thus adhered to the packing will be described below.

As conditions for removing iron fine particles in the high gradient magnetic separator, a magnetic field strength preferably is from 0.5 to 20 k gauss/cm, more preferably from 1 to 10 k gauss/cm, and most preferably from 1 to 5 k gauss/cm. A liquid linear velocity (inversely proportional to a residence time) in the magnetic separator preferably is from 0.5 to 10 cm/sec, more preferably from 0.5 to 5 cm/sec, and most preferably from 1 to 4 cm/sec. A liquid temperature in the high gradient magnetic separator preferably is from 150° to 350° C., more preferably from 180° to 320° C.

When the operation of magnetic separating iron fine particles is continued, the removing rate of iron decreases with increase of the amount of iron fine particles adhered to the packing. Accordingly, in order to maintain the removing rate of iron, the washing and removing step for discharging the adhered iron fine particles from the magnetic separator is required after passing the feed oil for a given time. In a practical industrial operation, the feed oil containing iron fine particles may be fed directly to the hydrogenation apparatus by by-passing the high gradient magnetic separator during the step for washing and removing. A spare high gradient magnetic separator for replacement may be provided as needed because an introducing amount of iron fine particles into the hydrogenation apparatus becomes large and the removing rate of iron decreases when the time required to wash is long.

In the step for washing and removing iron fine particles in the present invention, a fractionating tower bottom oil of the latter step of the hydrogenation apparatus can be utilized as a washing oil. Because the bottom oil usually has a high temperature of from 300° to 350° C., the bottom oil can be utilized as a heat source for heating the feed oil to an optimal operation temperature of a filter for solid materials and of the high gradient magnetic separator in the pre-treating system of the present invention.

The above step for washing and removing comprises eliminating the magnetic field around the packing (by switching off an electromagnetic coil for the high gradient magnetic separator), introducing the bottom oil from the bottom of the high gradient magnetic separator, and washing out iron fine particles merely adhered to the packing. As a washing condition, it was found that the washing speed is very large in a washing oil (bottom oil) linear velocity of from 1 to 10 cm/sec, more preferably from 2 to 6 cm/sec. By shortening the washing time of the high gradient magnetic separator, without using a plurality of a high gradient magnetic separators or a large-scale one, a small-size high gradient magnetic separator, a by-pass line for the feed oil, and a washing oil line are provided, and repeating alternations of the magnetizing and removing operation and the washing operation made possible to conduct the continuous running.

BEST MODE FOR CARRYING OUT THE INVENTION

The present invention will be described below with reference to the drawings.

Figure 1:
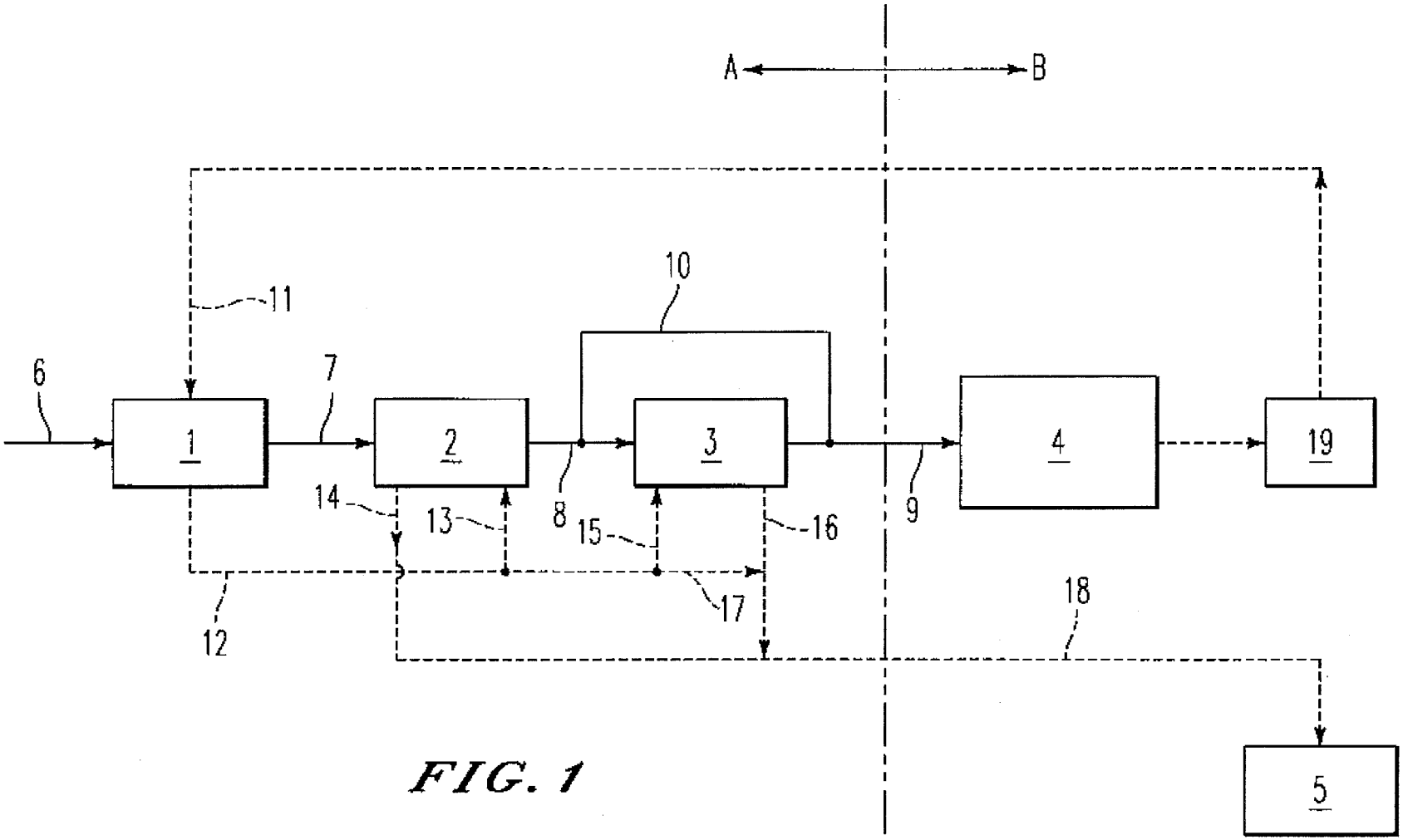
FIG. 1 is a block diagram illustrating a total system including a pre-treating part of a feed oil according to the present invention and a hydrogenation part.

FIG. 1 is a block diagram illustrating a total system including a pre-treating system of a feed oil according to the present invention and a hydrogenation part. In FIG. 1, the A side of a chain line is a pre-treating step part, and the B side of the chain line is a hydrogenation step part, and a solid line is a feed oil line and a dotted line is a washing oil line. A feed oil containing iron impurities is fed through a line 6 to a heater 1, the feed oil heated in the heater is fed to a filter for solid materials 2 and then to a high gradient magnetic separator 3 in which solid impurities and iron fine particles are removed, and the resulting feed oil is fed to a hydrogenation part 4 through line 9. A high temperature bottom oil (usually from 300° to 350° C.) of a fractionating distillation tower 19 of the latter step of the hydrogenation part is fed through a line 11 to the heater 1, and heats the feed oil by heat exchange so that the filter for solid materials 2 and the high gradient magnetic separator 3 have an optimal temperature for operating. If necessary, a heater or a cooler (not shown in FIG. 1) may be provided in a line 7 after the heater 1 to control the temperature of the feed oil. After utilizing the heat for generating steam and the like, the high temperature bottom oil is used as a washing oil 12 in the filter 2 and the high gradient magnetic separator 3 for removing solid impurities and iron fine particles accumulated by filtering and separating. The filter for solid materials 2 should preferably separate easily solid materials having a particle size of 25μ or more. A continuously back washing type filter is preferably used in the pre-treating system of the present invention. For example, the filter includes React Guard II (trade name: Ronningen-Petter). In React Guard II, any one of a number of filter elements can be always back washed with a washing oil. Accordingly, an amount of the bottom oil of the distillation tower of the hydrogenation apparatus fed to the filter 2 through a line 13 is small, and most of the bottom oil is fed through a line 15 to the high gradient magnetic separator 3 in which the bottom oil is used as a washing oil. If necessary, a heater or a cooler (not shown in FIG. 1) is provided in the lines 13 and 15 to control the temperature of the washing oil.

Filter elements of React Guard II used in the present invention are filters using a sintered surface made of stainless steel and can resist to repeating back washings. Two filter elements constitute a group, and seven groups comprising fourteen filter elements constitute one set, and these four sets are provided, and fifty six filter elements constituting twenty eight groups are always used for filtering. A pressure difference between an inlet and an outlet of the filter element is always detected, and when a given pressure difference (from 1 to 2 kg/cm$^2$) occurs, a program for back washing starts and the first one group of filter elements stops filtering and is automatically replaced to back washing. When the back washing is complete, the next group of filter elements is back washed. In this manner, twenty eight groups of filter elements are back washed in succession in about 1 minute. In the case of back washing, the above bottom oil is introduced from the outlet side of the filter and passed from the inside of the filter surface to the outside of the filter surface to wash adhered substances. After completing the washing in the filter 2, the bottom oil is discharged from a line 14 and mixed with a washing oil in the high gradient magnetic separator and fed through a line 18 to a bottom oil product tank 5 to store. React Guard II, that is, a filter of which amount of washing liquid may be small and washing speed is rapid is used before the high gradient magnetic separator, so that the system of the present invention becomes highly effective.

Figure 2:
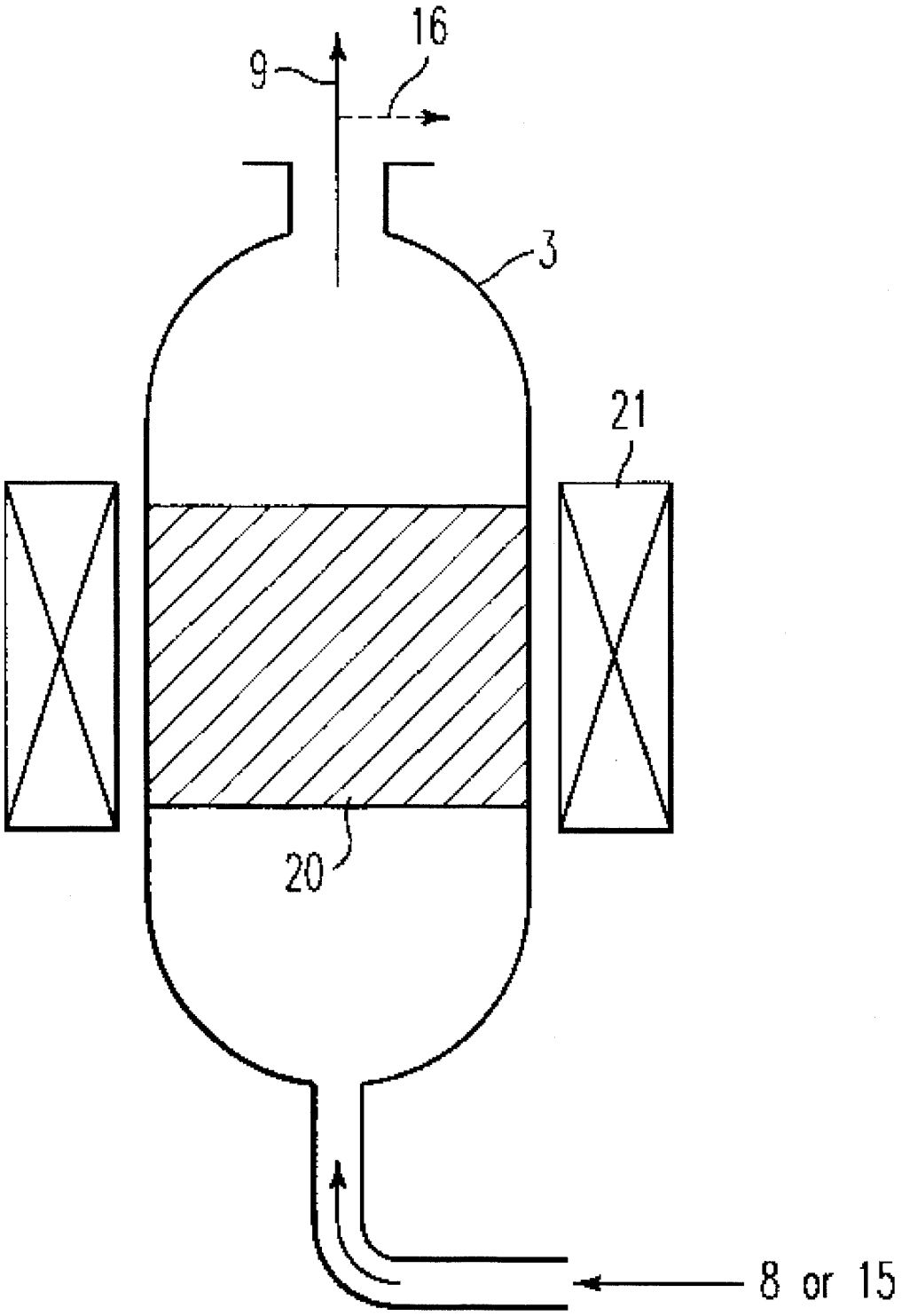
FIG. 2 is a simplified schematic view illustrating a high gradient magnetic separator used in the present invention.

A separation part of the high gradient magnetic separator 3 is composed of a longitudinal packed tower in which a shell-like ferromagnetic packing having a diameter of from 0.5 to 4 m/m is packed. FIG. 2 is a simplified schematic view illustrating the high gradient magnetic separator used in the present invention. A packed layer 20 having the packing packed is magnetized with a magnetic line of force generated by an electromagnetic coil 21 at the outside of the packed tower to form a high gradient magnetic separation part. The feed oil heated to an optimal operation temperature is passed through the magnetic separation part from the underside to the upper side at a given flow rate, preferably of from 1 to 4 cm/sec, and iron fine particles having a particle size of less than 25μ which could not be removed in the filter 2 are magnetically adhered to the surface of the packing and removed from the feed oil.

In FIG. 1, a line 10 and a line 17 are a feed oil by-pass line and a washing oil by-pass line of the magnetic separator 3, respectively. The washing oil is by-passed through the line 17 during the feed oil passes through the high gradient magnetic separator 3, and the feed oil is fed through the line 10 directly to the hydrogenation apparatus while the washing oil washes the high gradient magnetic separator.

A continuous running is possible by repeating replacements of the operation for removing iron and the operation for washing in these manner.

As is evident from a block diagram of FIG. 1, the present invention provides a pre-treating system of a feed oil for separating and removing solid impurities and iron fine particles which prevent a long-term operation of a hydrocracking or hydrodesulfurization apparatus, wherein a combination of the above high gradient magnetic separator and filter for solid materials is used, and heat of the bottom oil of a fractionating tower of hydrogenation apparatus is utilized by its recycling and the bottom oil is also utilized as a washing oil for the filter and the high gradient magnetic separator, thereby solid impurities and iron fine particles in the feed oil are continuously and economically removed to eliminate the operation preventing factors such as contamination or pressure drop of the subsequent catalytic reactor.

Figure 3:
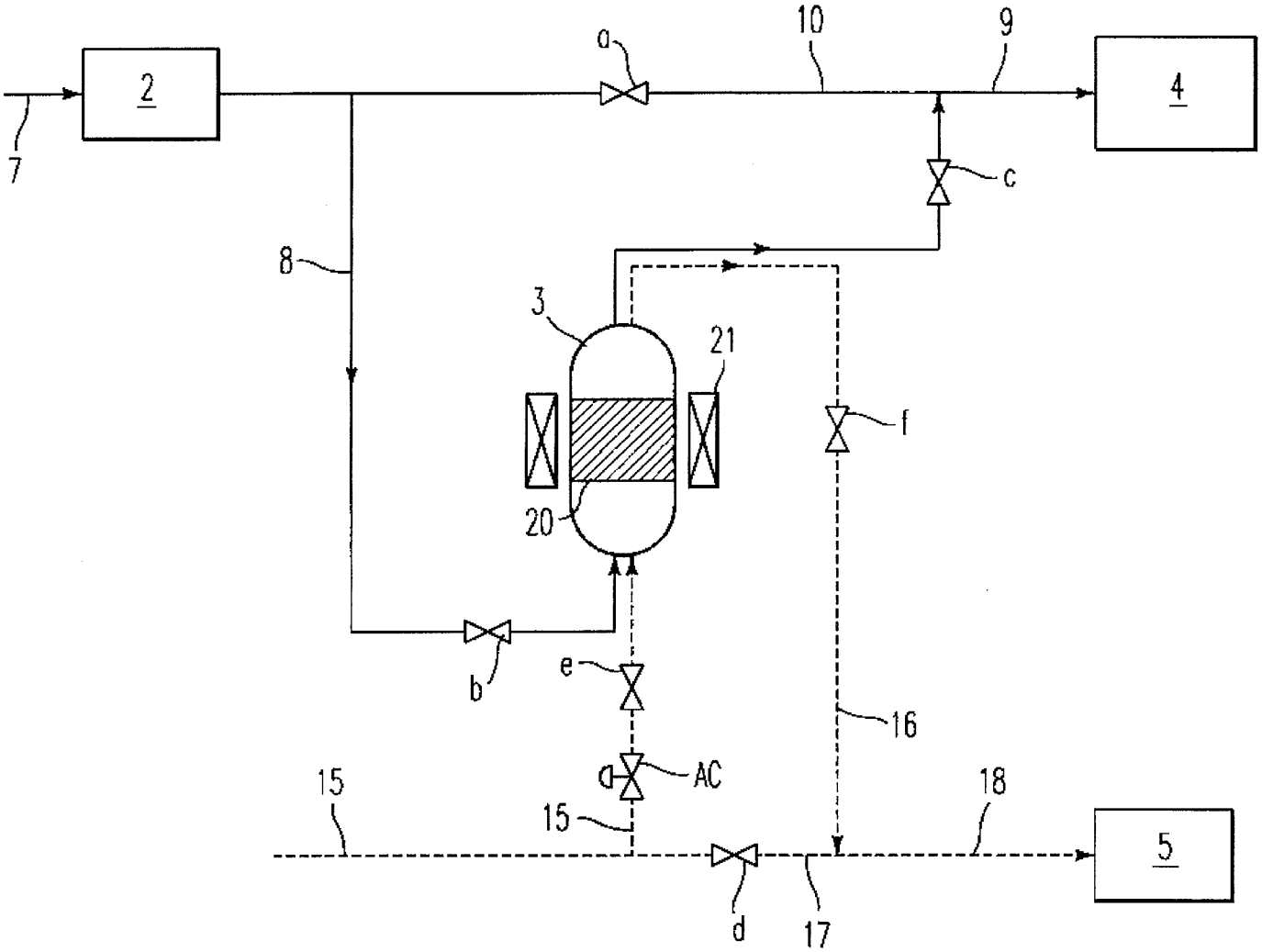
FIG. 3 is a flow diagram illustrating an operating method mainly with respect to the high gradient magnetic separator of the present invention.

FIG. 3 is a flow diagram illustrating a running for removing iron and a running for washing of the heavy oil pretreating system of the present invention, particularly mainly with respect to the high gradient magnetic separator 3. In FIG. 3, a solid line shows a feed oil feeding line, and a dotted line shows a washing oil line. Replacement of the iron removing operation and the washing operation is automatically carried out by a timer, and these operations are repeated by determining an iron removing time and a washing time. Relationships among automatic open-shut valves a, b and c in the feed oil line, automatic open-shut valves d, e and f in the washing oil line, an automatic replacement of a liquid flow pass by a timer, and ON and OFF of an electromagnetic coil 21 are as follows (manual replacement is possible):

| | Open and shut of valve | On and Off of electromagnetic coil |
|---|---|---|
| Iron removing operation | Open: b, c, d<br>Shut: a, e, f | On |

-continued

| | Open and shut of valve | On and Off of electromagnetic coil |
|---|---|---|
| Washing operation | Open: a, e, f<br>Shut: b, c, d | Off |

Namely, during the iron removing operation, the feed oil is passed through a line 8, the high gradient magnetic separator 3, and a line 9 and fed to the hydrogenation apparatus, while the washing oil is passed through a line 15 and a line 17 and fed to the bottom oil product tank 5. During the washing operation, the washing oil is passed through a line 15, the high gradient magnetic separator 3, and lines 16 and 18 and fed to the bottom oil product tank, while the feed oil is directly fed to the hydrogenation apparatus through a by-pass line 10.

The feed oil or washing oil up flowing through the packed layer 20 of the high gradient magnetic separator has a linear velocity in the given range as mentioned before. Particularly, with respect to the washing oil, in order to maintain the liquid linear velocity corresponding to the viscosity change of the bottom oil resulting from changes of operating conditions of the hydrogenation apparatus, an automatic flow rate controlling device having a previously prepared program is provided in the washing oil introducing line, and the temperature and viscosity of the washing oil introduced into the high gradient magnetic separator are measured, thereby instructions are given to an automatic control valve AC in the line 15 to control the liquid inflow amount.

By the use of the pre-treating system of the present invention as shown in FIGS. 1 to 3 and by the operating method of the pre-treating system, the feed oil containing from 5 to 50 ppm of iron fine particles having a particle size of less than 25μ which were not removed by the filter for solid materials 2 can be treated to reduce the iron fine particle content in the feed oil fed to the hydrogenation apparatus.

The present invention will be described below by giving an example.

<Example>

A pre-treating system of the present invention was arranged in a feed oil supply line of a desulfurization apparatus of petroleum distillation residual oil having a treating capacity of 12,500 barrel/day. A particle size distribution and a content of solid impurities and iron fine particles were as follows.

| | Solid impurities | Iron fine particles (after filtering solid impurities) |
|---|---|---|
| Particle size distribution | 25–100μ | 0.1μ–less than 25μ |
| Content (wt. ppm) | 100–200 | 40–50 |

The feed oil was first heated to 280° C. by heat exchange with a high temperature bottom oil having 300° C. fed from a fractionating tower of the latter step of a hydrogenation apparatus in a heat exchanger. Next, solid impurities having a particle size of 25μ or more were filtered with a number of filter elements composed of a sintered filter surface made of stainless steel using a filter for solid materials having a total filter area of 18.4 $m^2$. In this filter, when a pressure difference between the inlet and the outlet of 28 groups of filter elements reaches to from 1 to 2 $kg/cm^2$, a program for back washing starts, and one group of filter elements stops and is automatically replaced by back washing. Each of filter elements were successively back washed. The above bottom oil from the fractionating tower used for heating the feed oil was used as the washing oil. When a limiting pressure difference on the filter surface was detected, a controlling part automatically shut off the feed oil, and the above bottom oil was fed from the outlet side of the filter and passed from the inside of the filter surface to the outside of it to wash the filter. After washing, the washing oil was introduced into a bottom oil product tank of the hydrodesulfurization step. Next, in a high gradient magnetic separator, by generating a magnetic line of force of 3 k gauss with a consumption power of 70.5 kW, shell-like ferromagnetic pieces having a diameter of from 0.5 to 4 m/m made of stainless steel packed in the separation part were magnetized to form a high gradient magnetic separation part.

The feed oil and the washing oil were alternately upflowed to the magnetic separating tower from the bottom to repeat the iron removing operations and the washing operations, thereby carrying out a continuous running. The above bottom oil of the fractionating tower was used as the washing oil, and after washing the oil was returned to the bottom oil product tank. The operation conditions of the high gradient magnetic separator were as follows:

(a) Iron removing operation: Feed oil linear velocity: 3 cm/sec Iron removing time: 2 hours (b) Washing operation: Amount of washing oil: Maximum 12,000 barrel/day Minimum 6,500 barrel/day Washing oil linear velocity: 1.5–3 cm/sec Washing time: 10 minutes Replacement of the iron removing operation and the washing operation was carried out by automatic switch of the liquid flow pass using a combination of a timer and automatic open-shut valves and automatic on and off of an electromagnetic coil of the high gradient magnetic separator. An amount of the washing oil decreased maximum ½ depending on variation of the operation conditions of the hydrodesulfurization apparatus. The linear velocity of the washing oil in the high gradient magnetic separator was controlled by an automatic flow rate controlling device in the washing oil feeding line so as to have a given flow rate, but when the amount of the washing oil decreased significantly, the packed layer was divided and the one side was used.

A pressure difference between the inlet and the outlet of a desulfurization reactor, which is a measure showing a degree of contamination of a catalyst layer of the desulfurization reactor, became a limiting value of 6.0 $kg/cm^2$, for example after six months of the running start, to reach to an operating limit of the reactor when the present invention was not used, and thereafter the operation had to be carried out by decreasing the treating amount of the feed oil. When the feed oil was treated by the use of a novel pre-treating system of the present invention, the continuous running of the hydrodesulfurization apparatus was possible for one year or more long under the normal conditions.

Industrial Applicability

As described above, by the use of the feed oil pre-treating system and by its treating method of the present invention, iron fine particles which could not be removed in the prior art can be removed, and clog and deterioration of a catalyst layer of a hydrodesulfurization apparatus are reduced, thereby the time capable of continuous operation of the above apparatus could be extended about two times that of the conventional apparatus.

We claim:

1. A pre-treating apparatus provided in a feeding line of a petroleum heavy oil to be fed into a hydrogenation apparatus including at least a hydrogenation section and a fractionation tower, the pre-treating apparatus comprising:

a heater for heating the petroleum heavy oil to a desired temperature;

a continuous back-washing filter for filtering the heated oil so as to remove solid materials, said filter being capable of removing fine particles having particle diameters of 25 μm or more; and a high-gradient magnetic separator filled inside with ferromagnetic metal pieces each having a major axis of 0.5–5 mm, a curvature height of 0.3–0.5 mm and a bulk specific gravity of 3–4, wherein the filtered oil is passed through the high-gradient magnetic separator at a linear velocity of 0.5–10 cm/sec to adhere magnetic fine particles in the filtered oil to the metal pieces filled in the separator and remove said magnetic fine particles from the filtered oil, and the magnetic fine particles removed oil is fed into the hydrogenation apparatus;

said pre-treating apparatus further comprising:

means for feeding a washing oil into the high-gradient magnetic separator, and passing the oil through the magnetic separator in the form of an up-flow at a linear velocity of 1–10 cm/sec to remove the magnetic fine particles adhering to the ferromagnetic metal pieces.

2. An apparatus according to claim 1, wherein the temperature of the filtered oil in the magnetic separator is 150°–350° C.

3. An apparatus according to claim 1, wherein a bottom oil of the fractionation tower is used as the washing oil.

4. An apparatus according to claim 1, wherein the filtered oil from said filter is fed into a bottom of the high-gradient magnetic separator.

* * * * *